US009136606B2

(12) United States Patent
Simon et al.

(10) Patent No.: US 9,136,606 B2
(45) Date of Patent: Sep. 15, 2015

(54) ELECTRICALLY LARGE STEPPED-WALL AND SMOOTH-WALL HORNS FOR SPOT BEAM APPLICATIONS

(75) Inventors: Peter S. Simon, Camarillo, CA (US); Pamela Kung, Palo Alto, CA (US); Bruno W. Hollenstein, Santa Clara, CA (US)

(73) Assignee: SPACE SYSTEM/LORAL, INC., Palo Alto, CA (US)

( * ) Notice: Subject to any disclaimer, the term of this patent is extended or adjusted under 35 U.S.C. 154(b) by 1011 days.

(21) Appl. No.: 12/928,135

(22) Filed: Dec. 3, 2010

(65) Prior Publication Data

US 2012/0139807 A1 Jun. 7, 2012

(51) Int. Cl.
*H01Q 13/02* (2006.01)
*H01Q 25/00* (2006.01)

(52) U.S. Cl.
CPC ..... *H01Q 13/0208* (2013.01); *H01Q 25/001* (2013.01)

(58) Field of Classification Search
CPC .. H01Q 13/02; H01Q 13/0208; H01Q 25/001
USPC ..... 343/786
See application file for complete search history.

(56) References Cited

U.S. PATENT DOCUMENTS 4,604,627 A * 8/1986 Saad et al. ..... 343/786
6,208,309 B1 * 3/2001 Chandler et al. ..... 343/786
6,384,795 B1 5/2002 Bhattacharyya et al.
6,396,453 B2 5/2002 Amyotte et al.
7,110,716 B2 * 9/2006 Rao et al. ..... 455/13.3
7,183,991 B2 2/2007 Bhattacharyya et al.
7,463,207 B1 12/2008 Rao et al.

OTHER PUBLICATIONS

"A Smooth-Walled Spline-Profile Horn as an Alternative to the Corrugated Horn for Wide Band Millimeter-Wave Applications" by Christophe Granet, et al., IEEE Transactions on Antennas and Propagation, vol. 52, No. 3, Mar. 2004.
"Optimized Spline-Profile Smooth-Walled Tri-Band 20/30/44-GHz Horns" by Christophe Granet, et al., IEEE Transactions on Antennas and Propagation, vol. 6, 2007.
"A Novel Horn Radiator With High Aperture Efficiency and Low Cross-Polarization and Applications in Arrays and Multibeam Reflector Antennas" by Arun K. Bhattacharyya, IEEE Transactions on Antennas and Propagation, vol. 52, No. 11, Nov. 2004.

(Continued)

*Primary Examiner* — Michael C Wimer
(74) *Attorney, Agent, or Firm* — Kenneth W. Float

(57) ABSTRACT

Electrically large, stepped-wall or smooth-wall, direct-radiating horn antenna apparatus that may preferably be used in satellite spot beam applications. Exemplary electrically large smooth-wall horn antenna apparatus comprises one or more input ports, an electrically large output port, and a smooth-wall or stepped-wall tapered section having a spline-shaped profile extending from the input port(s) to the output port of the apparatus. The spline-shaped profile is preferably monotonic and is preferably configured to generate a spot beam. The spline-shaped profile may be configured to support multiple frequency bands, and dual simultaneous polarization having either linear or circular polarization. The spline-shaped profile is defined by spline knots, and, the knot radii form a nondecreasing sequence. Preferably, the spline-shaped profile comprises a piecewise cubic Hermite interpolating polynomial spline that interpolates the shape of curves between the spline knots.

19 Claims, 12 Drawing Sheets

(56) References Cited

OTHER PUBLICATIONS

"Comments and Replies" by Arun K. Bhattacharyya et al. and Kwok Kee Chan, et al., IEEE Transactions on Antennas and Propagation, vol. 56, No. 8, Aug. 2007.

"Design of High Efficiency Circular Horn Feeds for Multibeam Reflector Applications" by Kwok Kee Chan, et al., IEEE Transactions on Antennas and Propagation, vol. 56, No. 1, Jan. 2008.

"Monotone Piecewise Cubic Interpolation" by F. N. Fritsch et al, published in Siam J. Numer. Anal., vol. 17, No. 2, Apr. 1980.

"A Compact Multi-Flare Born Design for Spacecraft Reflector Antenna," by C. H. Chen et al., Antennas and Propagation Society International Symposium, 1986. vol. 24, pp. 907-910.

"A Square Multiflare Horn with 1-megawatt CW Power-Handling Capability," by Dan Hoppe, Microwave and Optical Technology Letters, vol. 2 No. 11, Nov. 1989, "Antenna System Supporting Multiple Frequency Bands and Multiple Beams," by Sudhakar K. Rao.

"Smooth-Walled Spline-Profile Ka-Band Horn covering both the full commercial and Military Bands," by Christophe Granet, et al., Microwave and Optical Technology Letters, vol. 50 No. 8, Nov. 2008.

"The Electrical Characteristics of the Conical Horn-Reflector Antenna " by J. N. Hines, et al., available from the NASA Astrophysics Data System, Feb. 11, 1963.

* cited by examiner

ELECTRICALLY LARGE STEPPED-WALL AND SMOOTH-WALL HORNS FOR SPOT BEAM APPLICATIONS

BACKGROUND

The present invention relates generally to satellites, and more particularly, to electrically large, circularly symmetric, stepped-wall and smooth-wall, direct-radiating horn antennas for use in satellite spot beam applications.

Electrically-small smooth-wall horns have been used as feeds for reflector antennas. In particular, smooth-wall horns have been used as feed elements in satellite-based, multibeam systems that employ array-fed, single offset reflectors. Advantages of smooth-wall horns include their compact size, low mass, high aperture efficiency, and ease of manufacture. The horn aperture for such multibeam applications typically measures less than about 6.5 wavelengths in diameter over the operating band, with maximum peak horn directivity less than 26 dBi.

A number of patents and open literature papers describe the use of profiled, smooth-wall horns for low-gain applications as feeds for reflector systems. However, it is believed that no spline-profiled, smooth-wall nor spline-profiled stepped-wall horn has heretofore been used to generate direct-radiating high-gain spot beams.

Exemplary patents and papers relating to profiled, smooth-wall horns for low-gain applications include U.S. Pat. No. 6,396,453 issued May 28, 2002, to Amyotte et al., U.S. Pat. No. 6,384,795 issued May 7, 2002 to Bhattacharyya et al., U.S. Pat. No. 7,183,991 issued Feb. 27, 2007 to Bhattacharyya et al., U.S. Pat. No. 7,463,207 issued Dec. 9, 2008 to Rao et al., along with papers entitled "A Smooth-Walled Spline-Profile Horn as an Alternative to the Corrugated Horn for Wide Band Millimeter-Wave Applications" by Christophe Granet, et al., IEEE Transactions on Antennas and Propagation, Vol. 52, No. 3, Mar. 2004, "Optimized Spline-Profile Smooth-Walled Tri-Band 20/30/44-GHz Horns" by Christophe Granet, et al., IEEE Transactions on Antennas and Propagation, Vol. 6, 2007, "A Novel Horn Radiator With High Aperture Efficiency and Low Cross-Polarization and Applications in Arrays and Multibeam Reflector Antennas" by Arun K. Bhattacharyya, IEEE Transactions on Antennas and Propagation, Vol. 52, No. 11, November 2004, "Comments and Replies" by Arun K. Bhattacharyya et al. and Kwok Kee Chan, et al., IEEE Transactions on Antennas and Propagation, Vol. 56, No. 8, Aug. 2007, "Design of High Efficiency Circular Horn Feeds for Multibeam Reflector Applications" by Kwok Kee Chan, et al., IEEE Transactions on Antennas and Propagation, Vol. 56, No. 1, Jan. 2008. Other papers include "A Compact Multi-Flare Born Design for Spacecraft Reflector Antenna," by C. H. Chen et al., Antennas and Propagation Society International Symposium, 1986, Vol. 24, pages 907-910, "A Square Multiflare Horn with 1-megawatt CW Power-Handling Capability," by Dan Hoppe, Microwave and Optical Technology Letters, Vol. 2 No. 11, Nov. 1989, "Antenna System Supporting Multiple Frequency Bands and Multiple Beams," by Sudhakar K. Rao, et al. IEEE Transactions on Antennas and Propagation, Vol. 56, No. 10, Oct. 2008, "Smooth-Walled Spline-Profile Ka-Band Horn covering both the full commercial and Military Bands," by Christophe Granet, et al., Microwave and Optical Technology Letters, Vol. 50 No. 8, Nov. 2008, and "The Electrical Characteristics of the Conical Horn-Reflector Antenna," by J. N. Hines, et al., available from the NASA Astrophysics Data System. Another paper relevant to this invention is "Monotone Piecewise Cubic Interpolation" by F. N. Fritsch et al, published in Siam J. Numer. Anal., Vol. 17, No. 2, Apr. 1980.

The problem addressed by the present invention is the generation of high-gain spot beams with linear or circular polarization using an antenna having low mass, small volume, simple construction, high reliability. Prior art solutions have used empty conical or pyramidal tapered horns, conical or pyramidal horns with a larger flare angle and with a dielectric lens inserted in the aperture for phase correction, small reflector/feed combinations, or waveguide slot arrays.

In view of the above, it would be desirable to have electrically large, circularly symmetric, stepped-wall and smooth-wall, direct-radiating horn antennas for use in satellite spot beam applications.

BRIEF DESCRIPTION OF THE DRAWINGS

The various features and advantages of the present invention may be more readily understood with reference to the following detailed description taken in conjunction with the accompanying drawing figures, wherein like reference numerals designate like structural element, and in which.

DETAILED DESCRIPTION

As was mentioned above, electrically small smooth-wall horns are commonly used as feeds for reflector antennas.

Disclosed herein are improvements over such electrically small smooth-wall horns in the form of electrically large, profiled, high directivity, stepped-wall and smooth-wall horn antennas that may be used onboard satellites as direct radiators for generating spot beams. Such electrically large, profiled, high directivity, stepped-wall and smooth-wall horn antennas may be used in single-band and multiple-band applications, such as antennas employed on satellites, for example. For the purposes of the present invention, the electrically large aperture diameters of the electrically large stepped-wall or smooth-wall horns are greater than 10 free space wavelengths.

More particularly, discussed below is another useful application for spline-profile, stepped-wall and smooth-wall horns as direct radiating antennas for generating high-directivity spot beams. Such applications can require horn apertures as large as 24 or more wavelengths with peak directivities exceeding 36 dBi.

Figure 1:
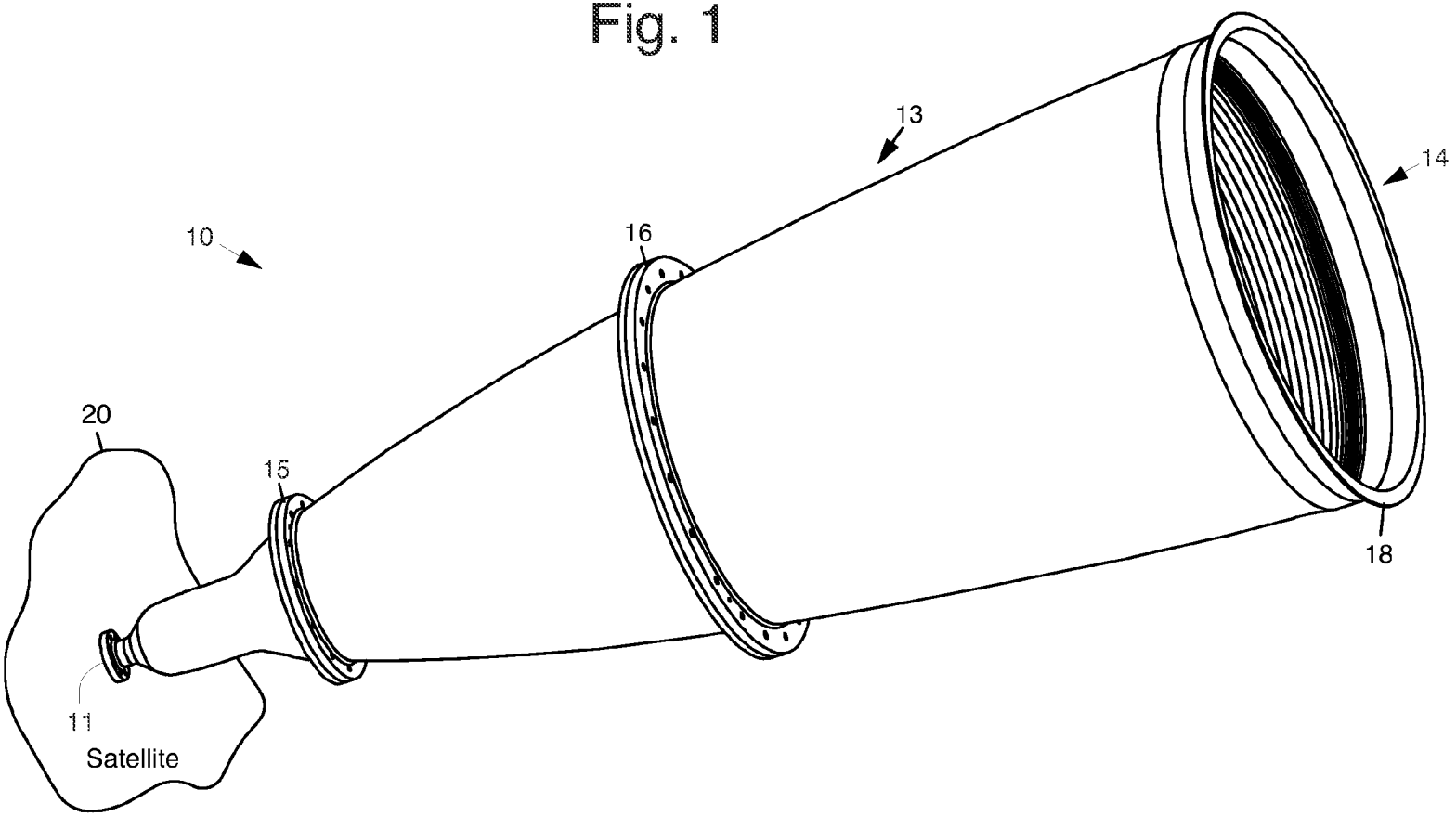
FIG. 1 illustrates a perspective view of an exemplary electrically large stepped-wall horn antenna.
Figure 1A:
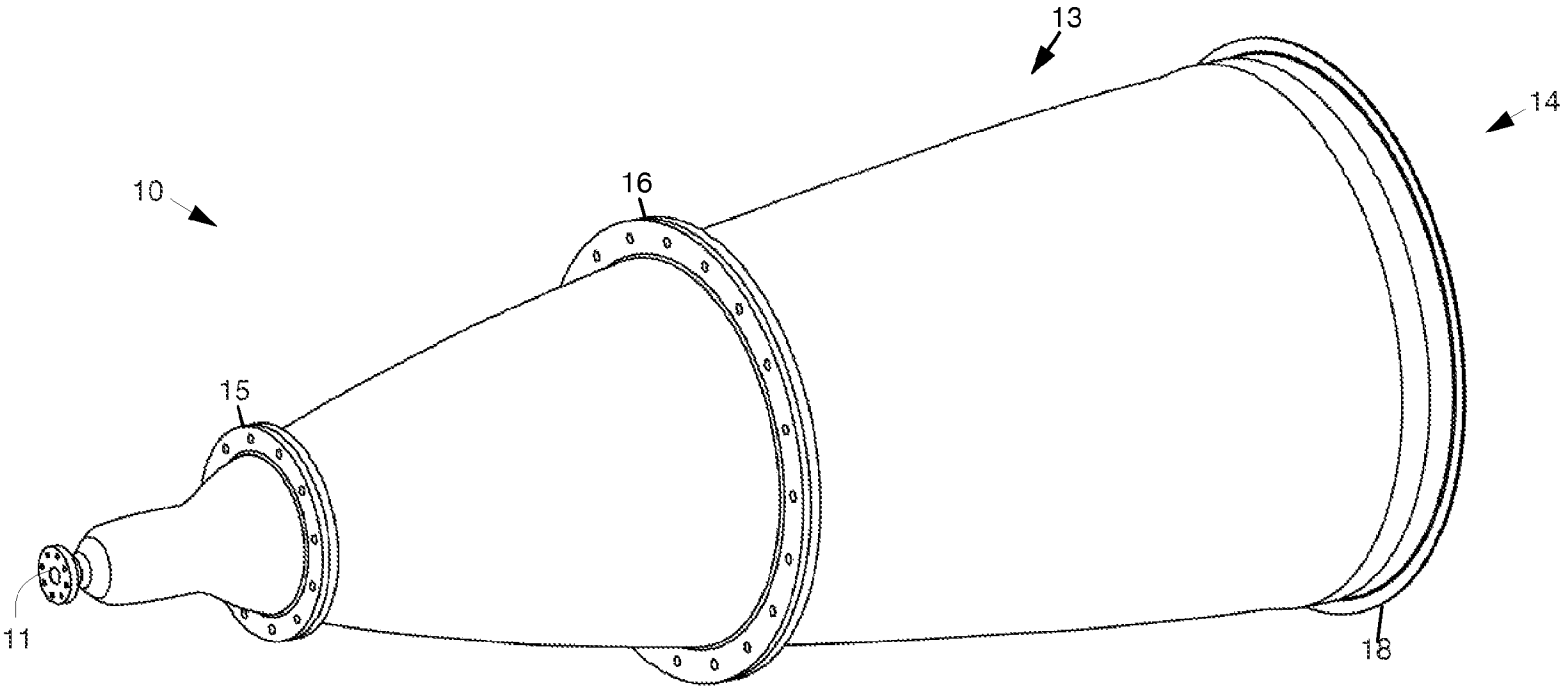
FIG. 1*a* illustrates another view of the stepped-wall horn antenna shown in FIG. 1.
Figure 1B:
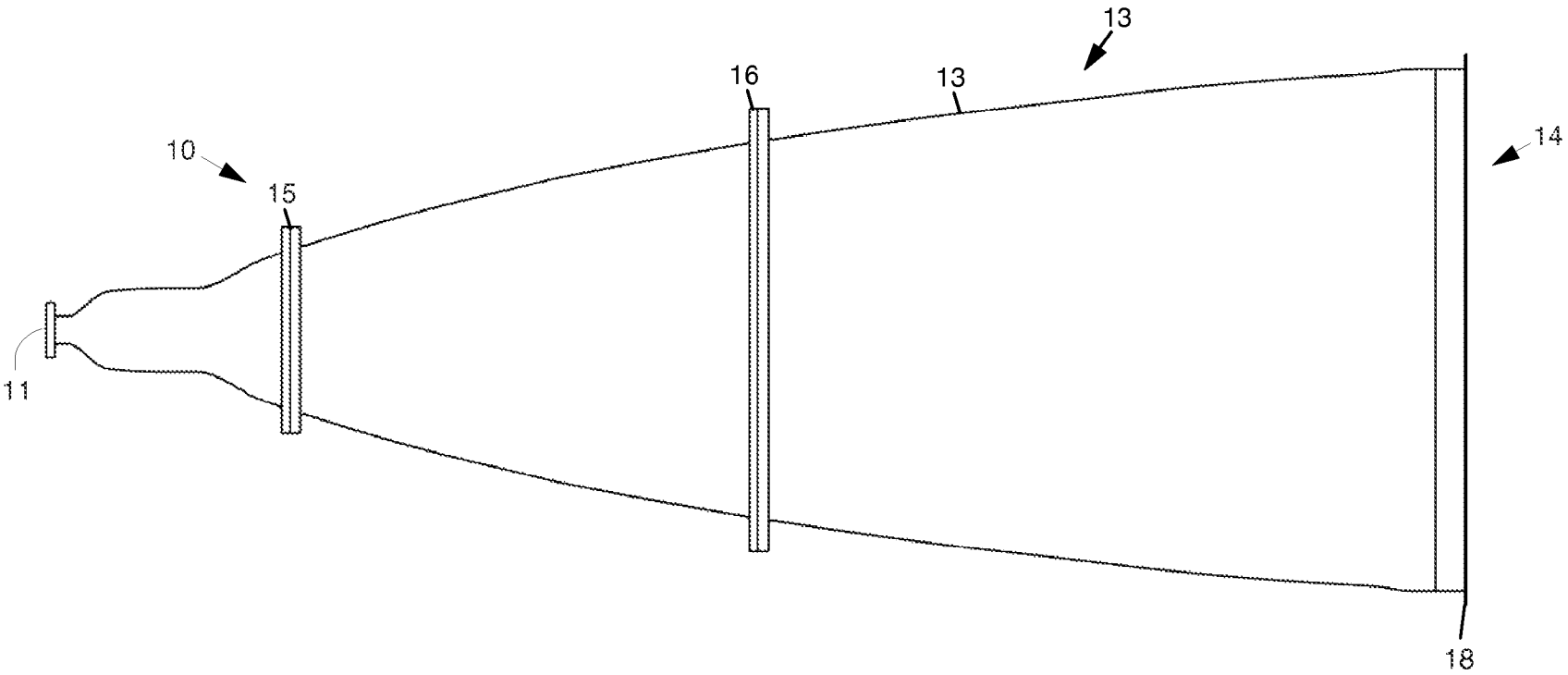
FIG. 1*b* illustrates a side view of the stepped-wall horn antenna shown in FIG. 1.
Figure 1C:
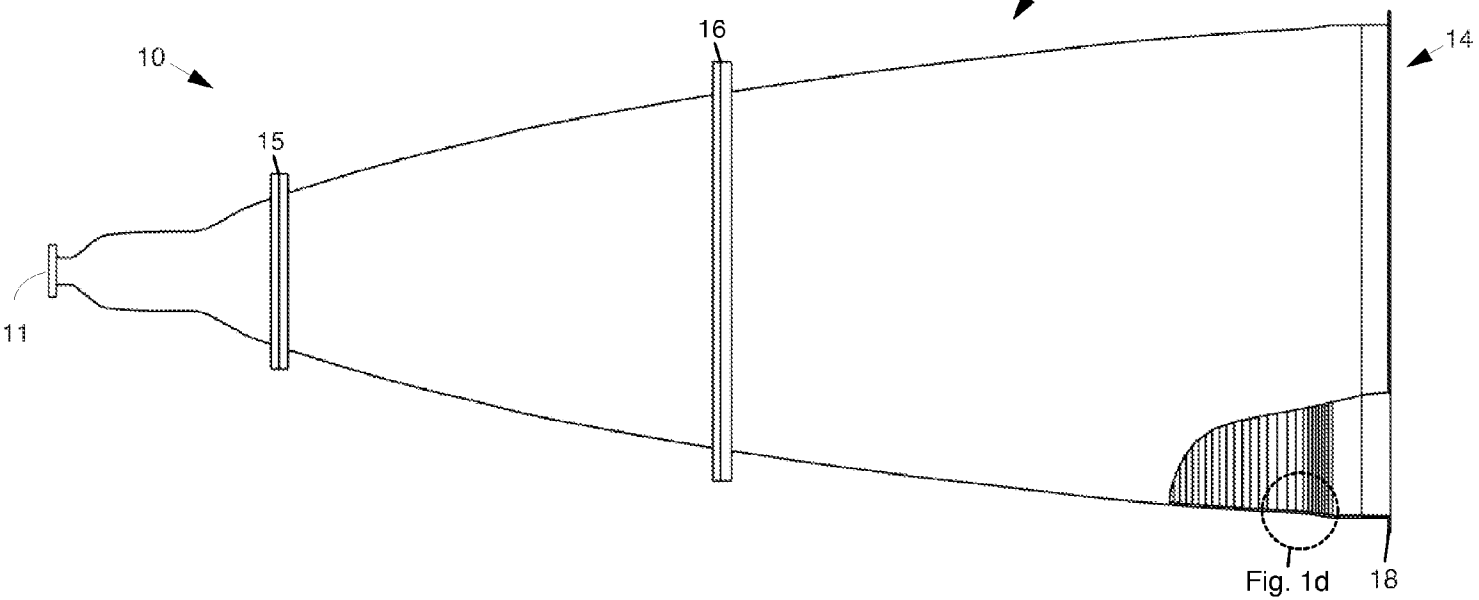
FIG. 1*c* illustrates a partially cutaway view of the stepped-wall horn antenna shown in FIG. 1.
Figure 1D:
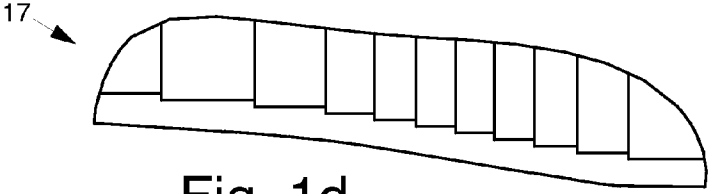
FIG. 1*d* illustrates an enlarged portion of a stepped wall tapered section of the stepped-wall horn antenna shown in FIG. 1.
Figure 2:
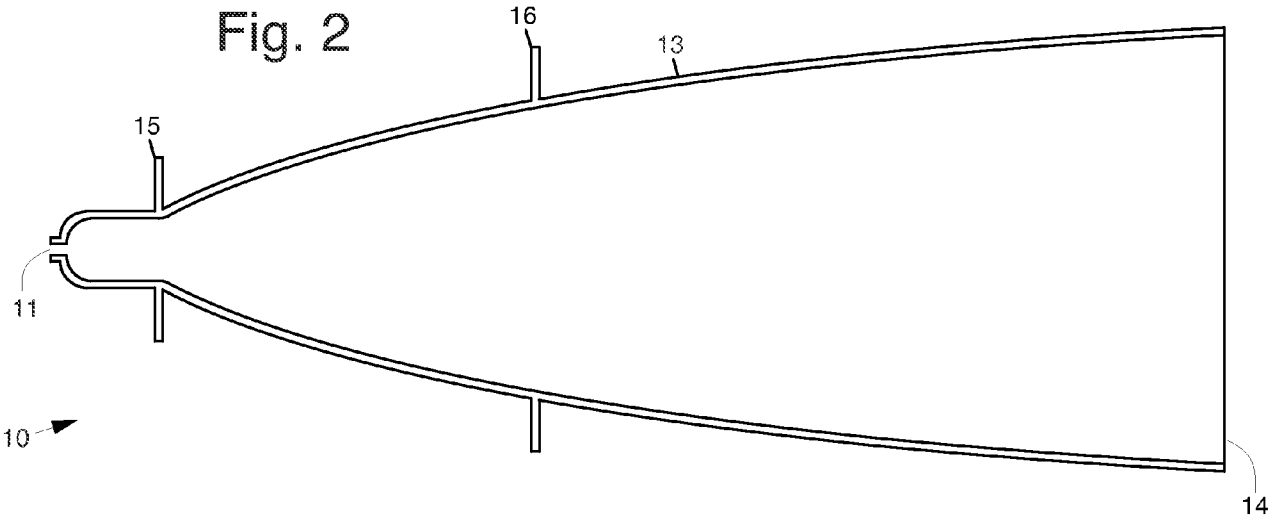
FIG. 2 illustrates a cross-sectional view of an exemplary electrically large smooth-wall horn antenna.
Figure 3:
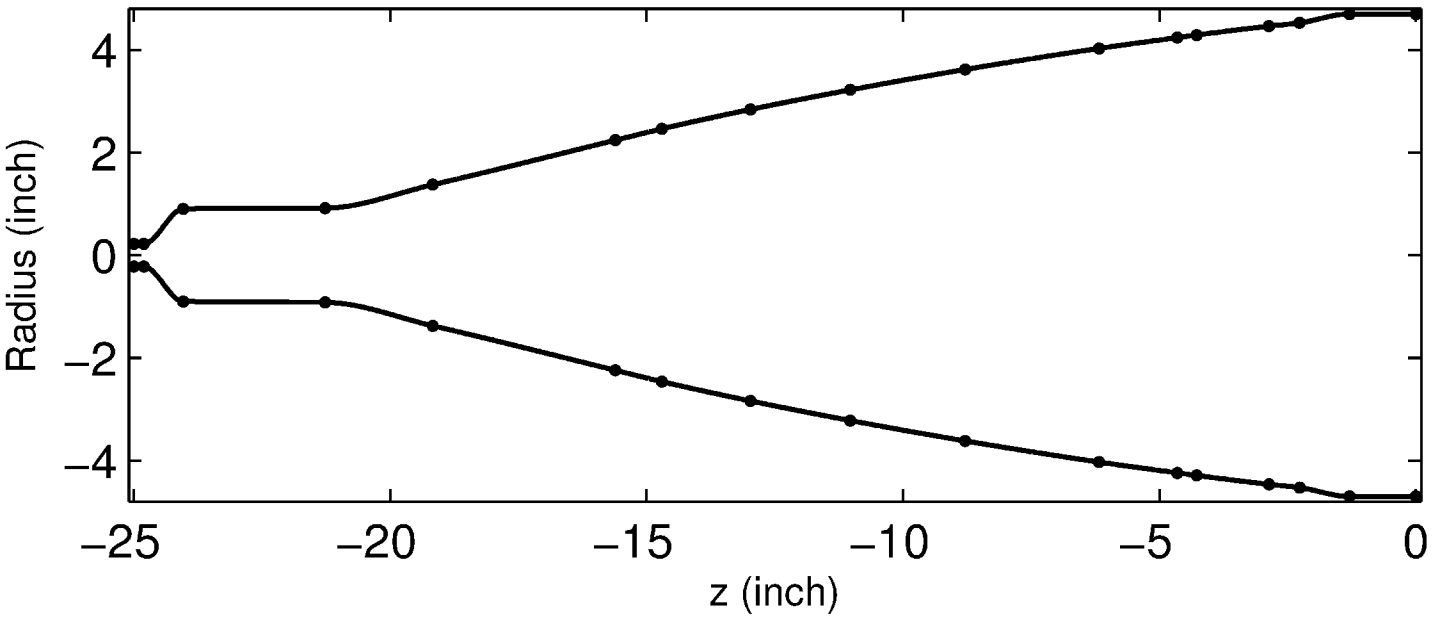
FIG. 3 illustrates the wall profile of another typical horn design.

Referring to the drawing figures, FIG. 1 illustrates a perspective view of an exemplary electrically large stepped-wall horn antenna 10, or horn antenna 10. FIG. 1a illustrates another view of the electrically large stepped-wall horn antenna 10. FIG. 1*b* illustrates a side view of the electrically large stepped-wall horn antenna 10. FIG. l*c* illustrates a partially cutaway view of the electrically large stepped-wall horn antenna 10. FIG. 1*d* illustrates an enlarged portion of a stepped wall tapered section 13 of the electrically large stepped-wall horn antenna 10. FIG. 2 illustrates a cross-sectional view of an exemplary electrically large smooth-wall horn 10, or horn antenna 10. A typical and exemplary horn profile is shown in FIG. 3. The disclosed horn antenna 10 has been designed for use on several satellites developed by the assignee of the present invention. The exemplary antennas 10 are advantageously employed on a satellite 20 or spacecraft 20.

The exemplary electrically large stepped-wall horn 10, or horn antenna 10, shown in FIGS. 1, 1*a*-1*c* and 2 comprise an input port 11 which is preferably configured to accept a circular waveguide input connector. In the embodiment shown in FIGS. 1, 1*a*, 1*b*, 1*c* and 1*d*, a stepped-wall tapered section 13 transitions from the input port 11 to an output port 14, or output aperture 14, of the horn 10. In the case shown in FIG. 2, a smooth-wall tapered section 13 transitions from the input port 11 to the output port 14 of the horn 10. A first cylindrical mounting flange 15 is disposed external to the horn 10 a small distance along the stepped-wall or smooth-wall tapered section 13 from the input port 11. A second cylindrical mounting flange 16 is disposed external to the horn 10 an additional distance along the exterior of the stepped-wall or smooth-wall tapered section 13. An optional stiffening rib 18 is formed adjacent the output port 14.

The stepped-wall or smooth-wall tapered section 13 has a predetermined profile that is designed to achieve an electrically large, high directivity horn 11. In particular, the stepped-wall or smooth-wall tapered section 13 of the electrically large smooth-wall horn antenna 10 preferably has a spline-shaped profile. FIG. 2 shows an exemplary spline-shaped profile. The stepped-wall profile uses a series of steps to approximate the corresponding smooth-wall profile.

The spline-shaped profile is monotonic in the sense that the radius (or equivalently, the diameter) of the horn never decreases as one traverses the profile from input port 11 to output port 14. Maintaining a monotonically nondecreasing horn profile is useful for the following reason: If the diameter were not constrained to be nondecreasing, one could encounter a situation where a large diameter region is located between two small diameter regions. Such a region could support one or more propagating modes that can not propagate in the surrounding regions—a form of resonant cavity. Trapped modes in such regions can give rise to very undesirable "spikes" and "glitches" in horn performance.

Figure 2A:
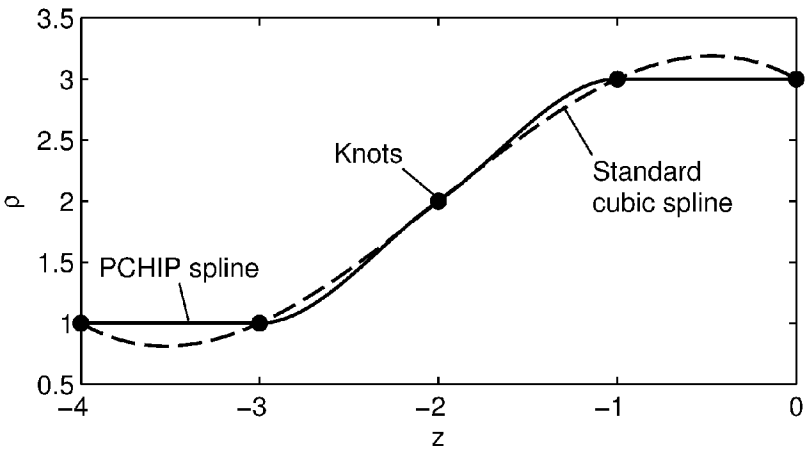
FIG. 2*a* is a graph that illustrates monotonicity properties of PCHIP spline versus a standard cubic spline.

A spline profile is fully characterized by a set of discrete knot z locations (where z is the axial distance measured along the horn profile) and corresponding radii at the knot locations, as shown by the black dots in FIG. 2*a*. Between the knot locations, the radius profile of the horn is determined by spline interpolation. A unique feature of this invention is the use of "PCHIP" (piecewise cubic Hermite interpolating polynomial) splines to interpolate the shape of the curve between the knot locations. The above-cited reference entitled "Monotone Piecewise Cubic Interpolation" by F. N. Fritsch et al., describes these splines. PCHIP splines sacrifice one degree of smoothness relative to the standard cubic splines that are employed exclusively in the prior art, in order to ensure that the interpolated curve respects and preserves the monotonicity present in the spline knots. For example, in FIG. 2*a* the sequence of knot radii p encountered from left to right is (1, 1, 2, 3, 3), which is clearly a monotonically nondecreasing sequence. However, as shown in the figure, a standard cubic spline interpolating this monotonic knot data is not itself monotonic because of the "undershoot" and "overshoot" it exhibits. In contrast, the PCHIP spline interpolating the same knot data results in a smooth curve that is also monotonically nondecreasing, respecting and preserving the monotonicity present in the knot data.

The horn profile is optimized so as to meet total length, return loss, and radiation pattern goals. The radiation pattern goals include edge of coverage directivity, cross-polarization suppression, pattern taper and other desired pattern properties of interest.

The basic parameterization of the horn 10 is smooth (a PCHIP spline). When the horn 10 is manufactured, sometimes the horn inner surface is preferably fabricated as a smooth surface of revolution using the smooth spline as the generating curve, but sometimes using a stepped approximation to the underlying smooth parameterization. Typically the steps are small, approximately 1/30 of a wavelength at the highest operating frequency, although that is not required.

For spot beam applications, horns 10 having size ranging from about 11 wavelengths in diameter at the lowest frequency for one application, to as large as 24 wavelengths in diameter at the highest frequency for another, different application have been developed by the assignee of the present invention. It is believed that the use of spline-profile, stepped-wall and smooth-wall horns 10 with apertures this large has heretofore not been used in the satellite communication art.

The design methodology for generating the horn profile is discussed below.

Horn Parameterization.

The horns 10 under consideration are bodies of revolution about the z-axis. The interior surface of the horn 10 is therefore completely characterized by the generating function, or horn profile function $\rho=f(z)$, where $\rho$ is the radius of the inner surface of the horn wall, and z is distance measured along the axis of the horn. The $z=0$ plane is chosen to coincide with the horn aperture plane, and the positive z direction is taken to be out of the horn, so that the body of the horn 10 lies in the $z<0$ half-space. The horn radius profile is represented as a PCHIP spline consisting of N spline sections (or horn sections) bounded by N+1 knots. For example, in FIG. 2*a* there are N=4 sections. The initial and terminal knot radii $\rho_0$ and $\rho_N>\rho_0$ are user-specified. The horn profile is then completely determined by the set of 2N−1 parameters $[L_1, L_2, \ldots, L_N, \rho_1, \rho_2, \ldots, \rho_{N-1}]$, which are the axial distances between adjacent knots and the profile radius evaluated at the interior knot locations. The knot radii are chosen to be a non-decreasing (monotonic) sequence of positive numbers, and the use of PCHIP splines to interpolate the spline profile ensures that the entire horn profile is also monotonic. Enforcing monotonicity guarantees that trapped mode regions (as discussed above) can never be formed in the horn profile.

Horn Optimization.

The particular values for the horn parameters are determined by numerical optimization of an objective function similar to that described by K. K. Chan and S. K. Rao, "Design of high efficiency circular horn feeds for multibeam reflector applications," IEEE Trans. Antennas Propagation, vol. 56, no. 1, pp. 253-258, January 2008, where departures from various performance goals (return loss, directivity, cross-polarization depth, etc.) evaluated at discrete optimization frequencies are squared, weighted, and added together to form the objective or cost function. To analyze the performance of a candidate horn 10, various techniques are available, such as mode matching, method of moments, finite difference time domain (FDTD), finite elements, as described in the previously cited references, and in the open literature.

Design Examples

Single-Band Design

Figure 4:
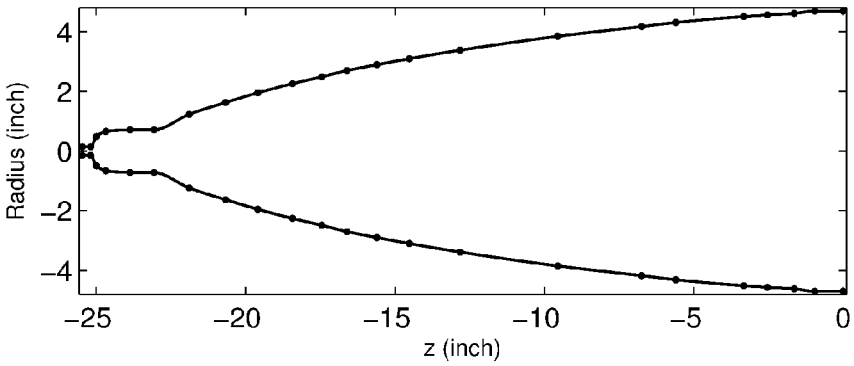
FIG. 4 illustrates an exemplary profile of a single-band horn showing knot locations.

The performance goals for this single-band design are shown in Table I. This horn 10 was optimized at 3 discrete frequencies using 22 horn sections. The profile of the 22-section horn 10 designed for this application is shown in FIG. 4.

TABLE I

| | |
|---|---|
| Frequency | 29.5-30 GHz |
| Polarization Dual CP | Dual circularly polarized |
| Angular coverage area | $\theta \leq 1.1°$ |
| Minimum directivity | 34.5 dBi |
| Minimum C/X | 27 dB |
| Minimum return loss | 25 dB |
| Input circ. waveguide diam. | 0.292 in |

The length and aperture inner diameter of the horn 10 are 25.46 inch and 9.4 inch, respectively, or approximately $65\lambda_{min}$ and $24\lambda_{min}$ ($\lambda_{min}$ being the wavelength at the highest frequency, 30 GHz). The inner surface of the horn 10 was manufactured as a stepped structure with constant steps in radius of approximately 0.01 in or $\lambda_{min}/40$.

Table II below shows knot coordinates for the exemplary single-band horn 10 whose profile is illustrated in FIG. 4, which will allow one skilled in the art to implement the horn profile, via PCHIP spline interpolation.

TABLE II

| z (inch) | Radius (inch) |
|---|---|
| −25.4620 | 0.1460 |
| −25.1795 | 0.1460 |
| −24.9847 | 0.4893 |
| −24.6726 | 0.6595 |
| −23.8664 | 0.7118 |
| −23.0571 | 0.7174 |
| −21.8829 | 1.2318 |
| −20.6632 | 1.6289 |
| −19.5902 | 1.9507 |
| −18.4288 | 2.2583 |
| −17.4492 | 2.4880 |
| −16.6084 | 2.6990 |
| −15.6078 | 2.8958 |
| −14.5200 | 3.0983 |
| −12.8078 | 3.3842 |
| −9.5586 | 3.8470 |

TABLE II-continued

| z (inch) | Radius (inch) |
|---|---|
| −6.7452 | 4.1748 |
| −5.6014 | 4.3103 |
| −3.3268 | 4.5108 |
| −2.5419 | 4.5620 |
| −1.6433 | 4.6146 |
| −0.9582 | 4.6999 |
| 0.0000 | 4.7000 |

Figure 5:
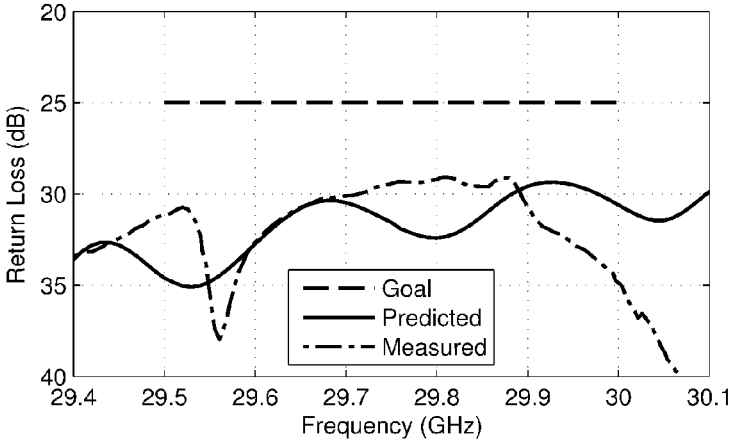
FIG. 5 is a graph that illustrates measured and predicted return loss of the exemplary single-band horn.
Figure 6:
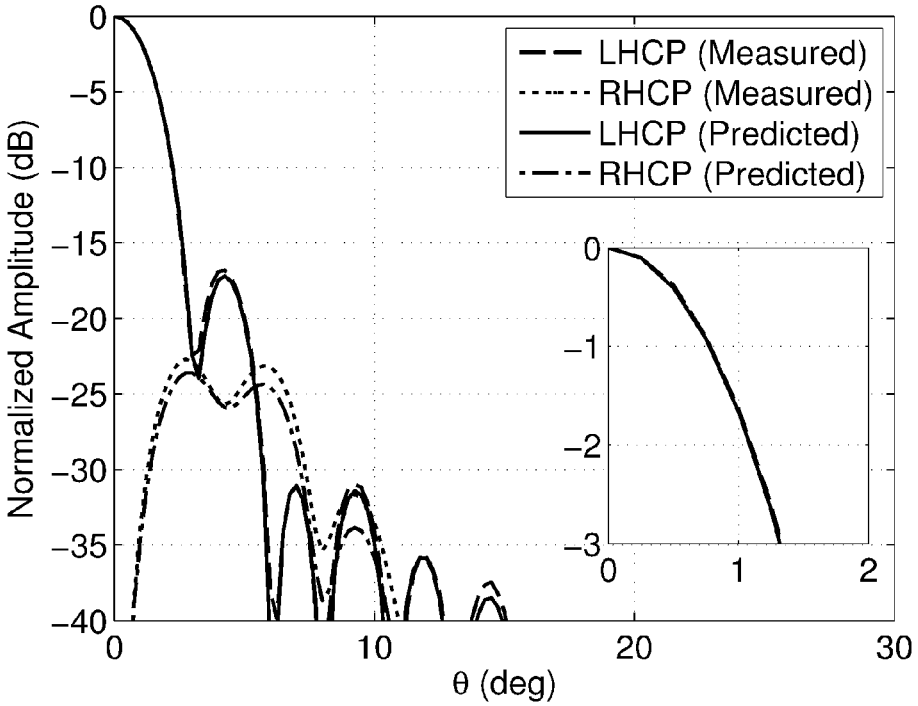
FIG. 6 is a graph that illustrates measured and predicted far-field pattern of the exemplary single-band horn at 29.75 GHz in the $\phi=0$ plane, with the horn excited for LHCP.

A comparison of the measured and predicted return loss is presented in FIG. 5. Predicted and measured patterns in the $\phi=0$ plane at the center frequency are shown in FIG. 6. Similar, excellent agreement between measured and computed patterns is obtained for the remaining frequencies and $\phi$-cuts.

Figure 7:
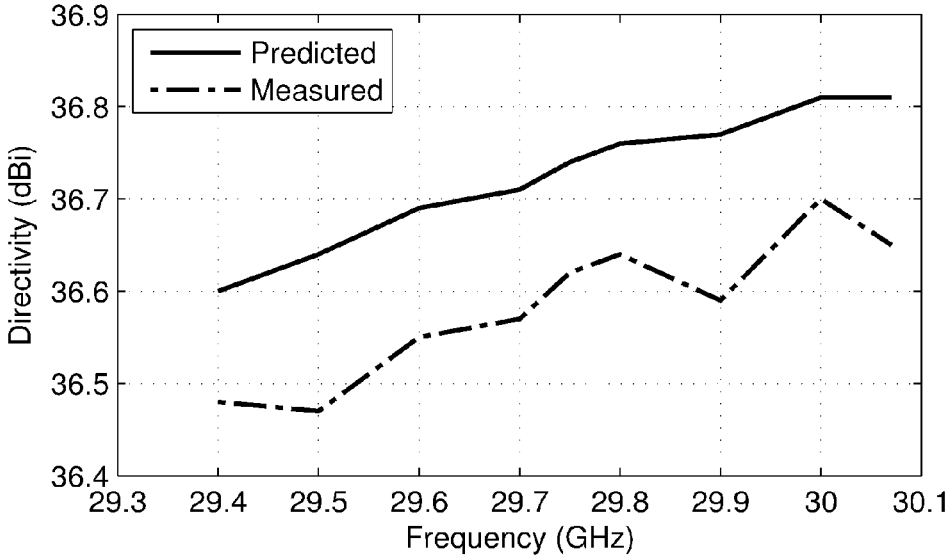
FIG. 7 is a graph that illustrates measured and predicted peak directivity of the exemplary single-band horn.

Peak directivity of the horn was estimated from the measured pattern cuts via numerical integration. The results are compared to predictions in FIG. 7. These measured peak directivities correspond to aperture efficiencies of about 82%, very nearly equal to that of a pure $TE_{11}$ mode with zero phase error (83.6%). The achieved aperture efficiency is remarkably high given the diameter and length of the horn 10. A conical horn with the same diameter aperture would require a length of more than 250 inches to obtain similar aperture efficiency. The reduced-to-practice single-band horn 10 meets all performance goals.

Dual-Band Design.

The performance goals for the design of this dual-band horn 10 are shown in Table III.

TABLE III

| | TX | RX |
|---|---|---|
| Frequency | 17.9-18.4 GHz | 27.5-28 GHz |
| Polarization Dual CP | LHCP | RHCP |
| Angular coverage area | $\theta \leq 1.12°$ | $\theta \leq 0.82°$ |
| Minimum directivity | 31.2 dBiC | 33.8 dBiC |
| Minimum C/X | 27 dB | 27 dB |
| Minimum return loss | 25 dB | 25 dB |
| Input circ. waveguide diam. | 0.472 in | 0.472 in |

Figure 8:
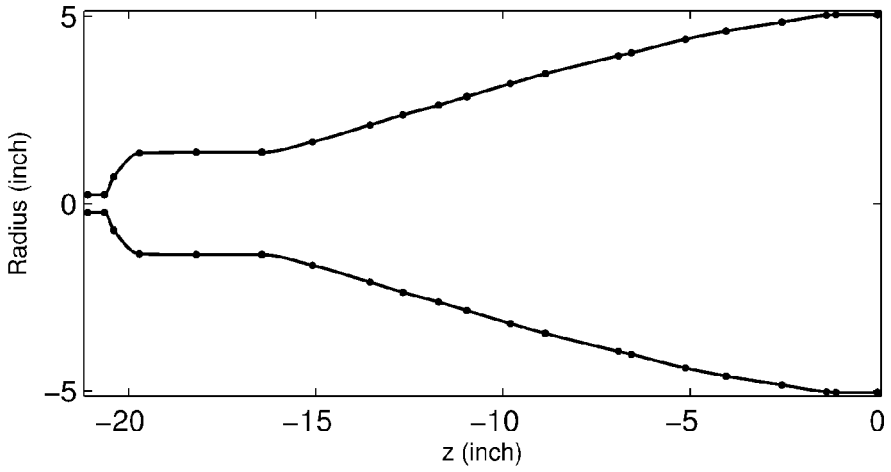
FIG. 8 illustrates an exemplary profile of a dual-band horn showing knot locations.
Figure 9:
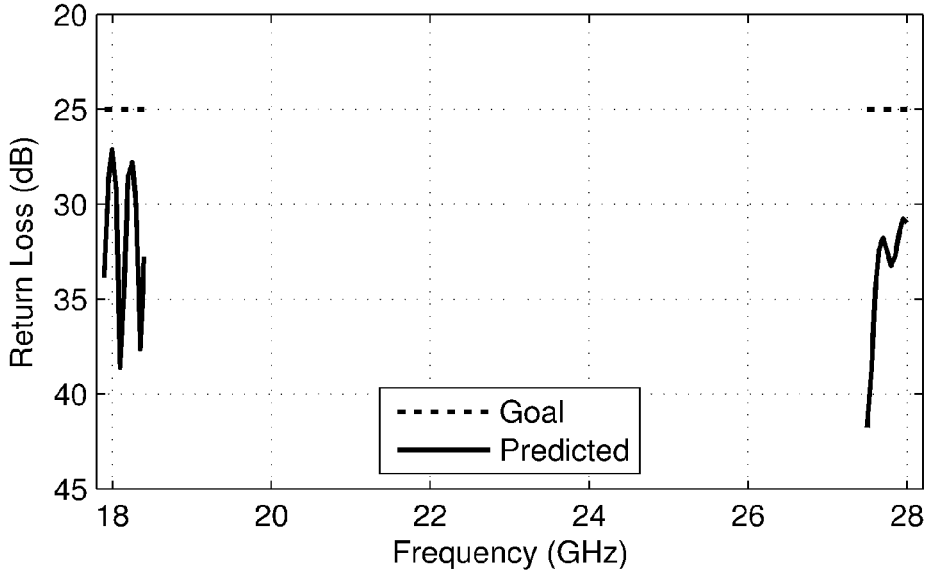
FIG. 9 is a graph that illustrates predicted return loss of the exemplary dual-band horn.
Figure 10:
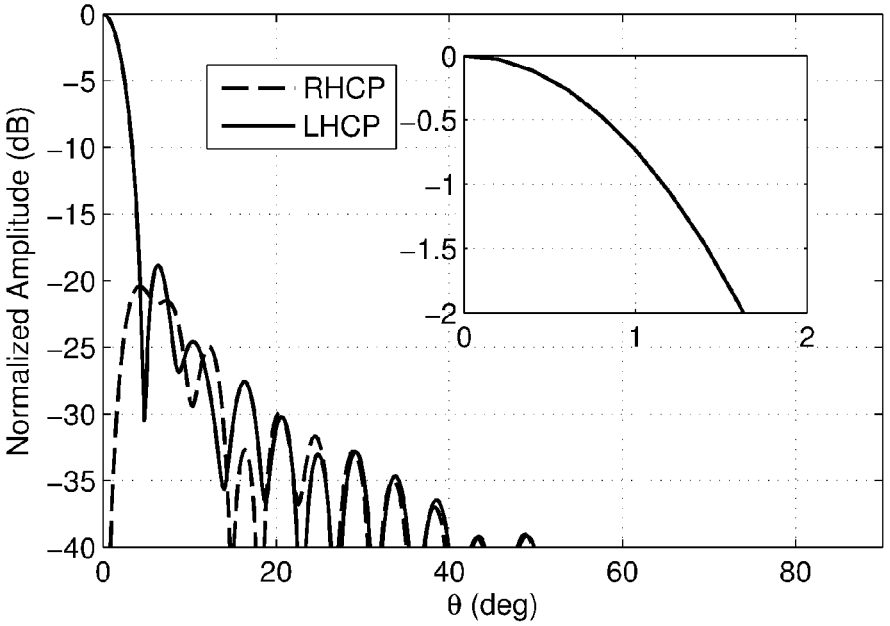
FIG. 10 is a graph that illustrates predicted far-field pattern of dual-band horn at 18.15 GHz in $\phi=0$ plane, with the horn excited for LHCP, with peak directivity of 32.40 dBi.
Figure 11:
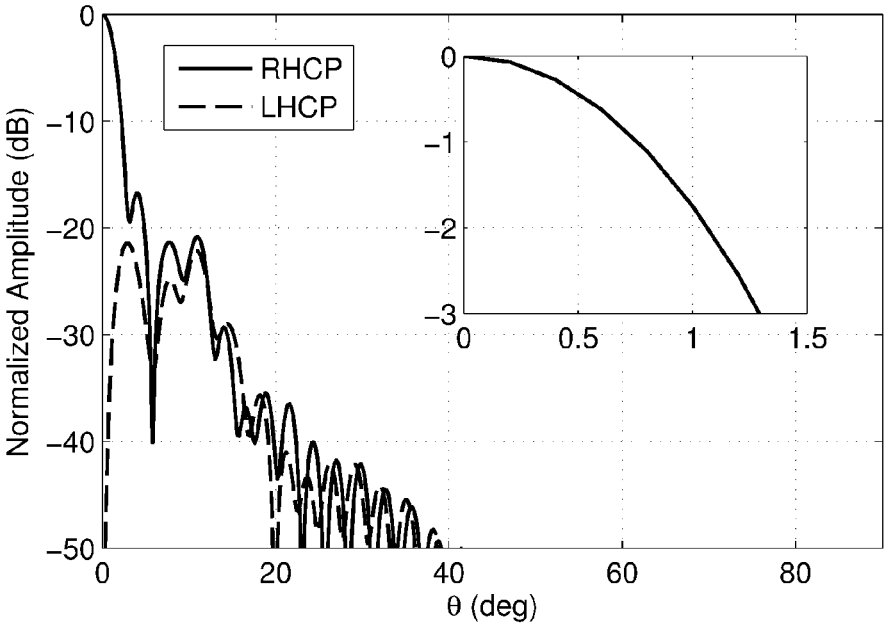
FIG. 11 is a graph that illustrates predicted far-field pattern of dual-band horn at 27.75 GHz in the $\phi=0$ plane, with the horn excited for RHCP, with peak directivity is 35.20 dBi.

The profile of the 20-section horn 10 designed for this application is shown in FIG. 8. The horn's length and aperture inner diameter are 21.09 inches and 10.1 inches, respectively, or approximately $50\lambda_{min}$ and $24\lambda_{min}$ (at 28 GHz). Return loss is shown in FIG. 9. Patterns at the two mid-band frequencies are shown in FIGS. 10 and 11.

Table IV below shows knot coordinates for the exemplary dual-band horn 10 illustrated in FIG. 8, which will allow one skilled in the art to implement the horn profile via PCHIP spline interpolation.

TABLE IV

| z (inch) | radius (inch) |
|---|---|
| −21.0918 | 0.2360 |
| −20.6437 | 0.2360 |
| −20.3937 | 0.7130 |
| −19.7101 | 1.3458 |
| −18.1917 | 1.3669 |
| −16.4415 | 1.3669 |
| −15.0837 | 1.6507 |
| −13.5565 | 2.0978 |
| −12.6759 | 2.3724 |
| −11.7193 | 2.6286 |
| −10.9636 | 2.8574 |

TABLE IV-continued

| z (inch) | radius (inch) |
|---|---|
| −9.8072 | 3.2031 |
| −8.8737 | 3.4684 |
| −6.9103 | 3.9480 |
| −6.5723 | 4.0269 |
| −5.1281 | 4.3920 |
| −4.0424 | 4.6084 |
| −2.5461 | 4.8455 |
| −1.3622 | 5.0323 |
| −1.1122 | 5.0500 |
| 0.0000 | 5.0500 |

Figure 12:
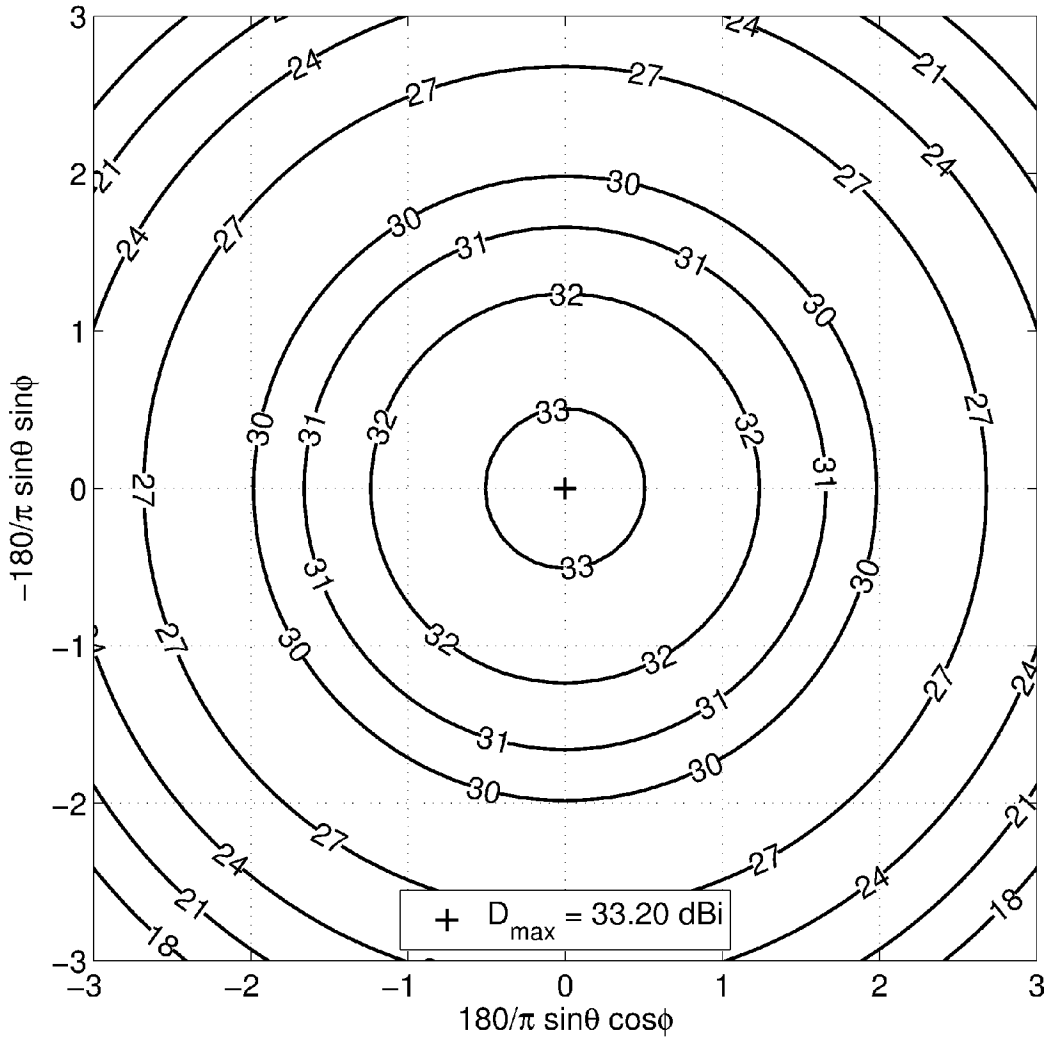
FIG. 12 illustrates a transmit gain pattern at 19.950 GHz for an exemplary horn.
Figure 13:
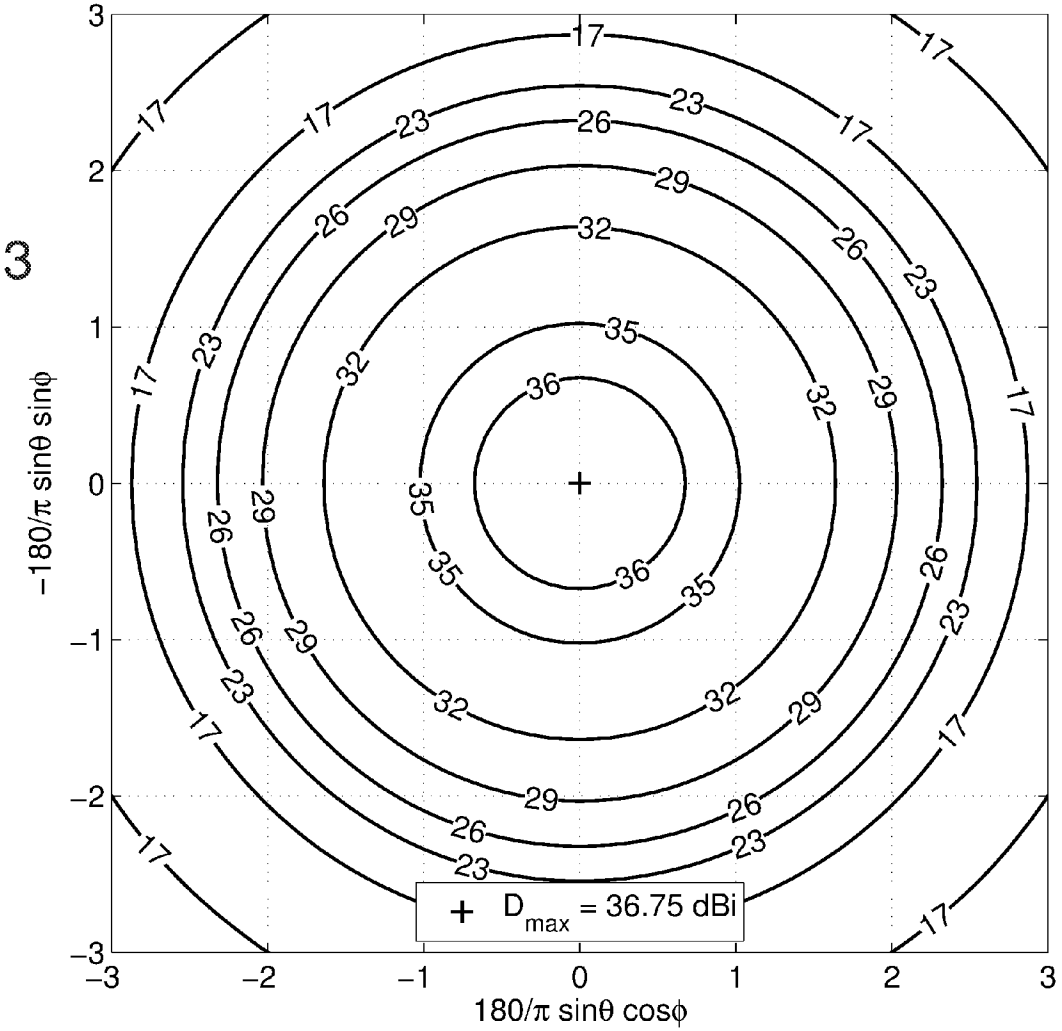
FIG. 13 illustrates a receive gain pattern at 29.750 GHz for an exemplary horn.

As was mentioned above, the disclosed horns 10 generate high-gain spot beams. FIG. 12 illustrates a transmit gain pattern at 19.95 GHz for another exemplary reduced-to-practice horn 10, whose profile is illustrated in FIG. 3. FIG. 13 illustrates a receive gain pattern at 29.75 GHz for the exemplary reduced-to-practice horn 10 whose profile is illustrated in FIG. 4 and whose spline knot locations are described in Table II.

Reduced-to-practice profiled horns 10 are much shorter (and therefore have lower mass and volume) compared with prior art (empty) conical or pyramidal horns. The horn 10 is much simpler, less massive and less expensive than a conventional horn with a dielectric lens, and is much simpler and less expensive than a horn/reflector combination. Compared to a waveguide slot array, the horn 10 is much simpler, and can support multiple frequency bands, dual simultaneous polarization, of either linear or circular polarization. Waveguide slot arrays are very narrow band, single-band, single-polarization antennas.

In summary, compared to conical horns, the electrically large smooth-wall horn 10 has a spline-profile shape. A novel parameterization of the horn profile is used that guarantees monotonicity of the profile radius versus axial length of the horn 10 during the numerical optimization process used to arrive at the horn profile. This monotonicity property is desirable since it precludes the existence of any regions of the horn 10 that could support trapped modes, which can cause undesirable return loss and directivity spikes. The other novel feature is the large electrical size of the horn aperture 14, particularly one used in a spot beam application. For example, aperture diameters exceeding 24 wavelengths have been successfully designed, built, and tested by the assignee of the present invention.

The disclosed horns 10 are direct radiating horn antennas 10 that produce high gain spot beams having linear or circular polarization. The horns 10 have stepped- or smooth-wall spline profiles generated using an algorithm and optimization procedure that ensures monotonicity to avoid trapped modes. The horns 10 preferably have electrically-large aperture with diameters typically a 10 free space wavelengths to provide for high gain. The horns 10 have a much shorter physical length compared with conventional horns (conical/multi-flare/multi-step) of the same aperture size and are thus more desirable for use on a satellite 20. The horns 10 have a lighter weight and ease of manufacturing (compared with conventional corrugated horns and horn reflector antennas). The horns 10 have high aperture efficiency. Reduced-to-practice horns 10 exhibit low cross-polarization in the intended coverage area hence high copolarization to cross-polarization ratio. The horns 10 may be single-band or multiple-band.

Thus, electrically large stepped-wall and smooth-wall horns for use in satellite spot beam applications have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An antenna horn comprising:

at least one input port;

an output port; and a tapered section, disposed between the at least one input port and the output port, having an interior surface shaped as a profile revolved around an axis of revolution, the profile comprising:

(1) discrete profile points, each discrete profile point having a corresponding axial location along the axis and a corresponding radius from the axis;

the radii forming a nondecreasing sequence of positive numbers from the at least one input port to the output port;

a first discrete profile point and a last discrete profile point defining respective input and output apertures of the tapered section, wherein the radius and axial location of the first point and the radius of the last point are preselected;

other discrete profile points disposed between the first and last discrete profile points, whose axial locations and radii and the axial location of the last discrete profile point are determined by numerical optimization of a set of objective functions; and (2) a continuous profile disposed between and overlapping the discrete profile points, the shape of the continuous profile comprising a piecewise cubic Hermite interpolating polynomial (PCHIP) spline.

2. The apparatus recited in claim 1 wherein the tapered section has a smooth-wall profile, a stepped-wall profile, or a smooth and stepped wall profile.

3. The apparatus recited in claim 1 wherein the output port has a large electrical dimension.

4. The apparatus recited in claim 1 which is disposed on a satellite.

5. The apparatus recited in claim 1 wherein the profile comprising the tapered section is shaped so as to generate a spot beam.

6. The apparatus recited in claim 1 wherein the profile radius is monotonically nondecreasing from the input aperture to the output aperture.

7. The apparatus recited in claim 1 wherein the profile is shaped so as to support multiple frequency bands.

8. The apparatus recited in claim 1 wherein the profile is shaped so as to support dual simultaneous polarization having either linear or circular polarization.

9. The apparatus recited in claim 1 wherein the horn receives, or transmits, or both receives and transmits RF signals.

10. The apparatus recited in claim 1 wherein the horn comprises a direct-radiating antenna without an accompanying reflector that generates a spot beam.

11. The apparatus recited in claim 1 wherein piecewise cubic Hermite interpolating polynomial spline coefficients are configured so as to guarantee monotonicity of the continuous profile along the axis.

12. A method of designing an interior surface of an antenna horn, comprising:

(1) assigning an axis of revolution around which a profile defines a surface of revolution comprising the interior surface of the antenna horn;

(2) structuring profile parameters as:

N+1 discrete profile points having 2N+1 parameters $[L_1, L_2, \ldots, L_N, \rho_0, \rho_1, \rho_2, \ldots, \rho_N]$, wherein at each discrete profile point, L is axial distance from the previous point and ρ is radius from the axis;

(3) optimizing parameter values by:

(a) preselecting values of parameters $\rho_0$ and $\rho_N$, where $\rho_N > \rho_0$; and (b) determining values of 2N−1 remaining parameters $[L_1, L_2, \ldots, L_N, \rho_1, \rho_2, \ldots, \rho_{N-1}]$ by numerically optimizing a set of objective functions while constraining $\rho_0, \rho_1, \rho_2, \ldots, \rho_N$ to be a nondecreasing, monotonic, sequence of positive numbers; and (4) generating a curve intersecting the N+1 discrete profile points using piecewise cubic Hermite interpolating polynomial (PCHIP) spline interpolation to define the interior surface of the antenna horn.

13. The method recited in claim 12 wherein the surface of revolution has its largest diameter approximately 10 wavelengths.

14. The method recited in claim 12 wherein the surface of revolution has its largest diameter larger than 10 wavelengths.

15. The method recited in claim 12 wherein the profile is smooth, stepped, or smooth and stepped.

16. The method recited in claim 12 wherein the profile is shaped to generate a spot beam.

17. The method recited in claim 12 wherein the profile is shaped to support multiple frequency bands.

18. The method recited in claim 12 wherein the profile is shaped to support dual simultaneous polarization having either linear or circular polarization.

19. The method recited in claim 12 wherein the profile is configured to support multiple frequency bands, and dual simultaneous polarization having either linear or circular polarization.

* * * * *